US005713483A

United States Patent [19]

Ata et al.

[11] Patent Number: 5,713,483

[45] Date of Patent: Feb. 3, 1998

[54] TRANSPORTABLE BROMINATOR AND A METHOD FOR HOLDING AND TRANSPORTING A PRODUCT

[75] Inventors: Ali Ata, Downers Grove; Mark Hermiller, Chicago; Lonnie A. Veldhouse, Batavia; Robert Witaszczyk, Chicago, all of Ill.

[73] Assignee: Naolco Chemical Corporation, Naperville, Ill.

[21] Appl. No.: 605,365

[22] Filed: Feb. 22, 1996

[51] Int. Cl.[6] ..... B65D 90/04

[52] U.S. Cl. ..... 220/448; 220/410; 220/469; 220/663

[58] Field of Search ..... 220/421, 663, 220/662, 664, 469, 448, 565, 445, 671, 410, 408

[56] References Cited

U.S. PATENT DOCUMENTS

| | | | |
|---|---|---|---|
| 1,851,024 | 3/1932 | Trainer et al. | 220/448 |
| 3,197,066 | 7/1965 | Denzler et al. | 220/448 |
| 3,208,622 | 9/1965 | Trentham et al. | 220/421 |
| 4,027,379 | 6/1977 | Cheng et al. | 220/421 |
| 4,286,723 | 9/1981 | Schutz . | |
| 4,519,415 | 5/1985 | Carn | 220/565 |
| 4,702,385 | 10/1987 | Shillington et al. | 220/663 |
| 5,054,645 | 10/1991 | Sharp | 220/469 |
| 5,071,166 | 12/1991 | Marino | 220/445 |
| 5,285,914 | 2/1994 | Del Zotto . | |
| 5,465,865 | 11/1995 | Coombes | 220/410 |
| 5,494,183 | 2/1996 | Sharp | 220/445 |
| 5,582,310 | 12/1996 | Del Zotto | 220/410 |

FOREIGN PATENT DOCUMENTS

| | | | |
|---|---|---|---|
| 420596 | 12/1935 | United Kingdom | 220/448 |

OTHER PUBLICATIONS

Nalco Brochure depiciting the EASIBROM System.

Nalco Brochure depicting the Bromine By-Pass Feeders.

*Primary Examiner*—Stephen J. Castellano

*Attorney, Agent, or Firm*—Hill, Steadman & Simpson

[57] ABSTRACT

A transportable brominator is provided for storage and transport of a hazardous product and subsequent feeding of the product. A tank is provided having inlet and outlet valves for filling and feeding of the product. The tank has an exterior wall having a first layer formed of a plastic, such as polyethylene, and a second reinforcing layer. The tank is placed within a shell, preferably stainless steel, with cushions arranged between the exterior walls of the tank and the interior of the shell. As a result, the brominator may be transported without damage to the shell. A sightglass is arranged in an exterior wall of the tank to view product therein.

13 Claims, 4 Drawing Sheets

TRANSPORTABLE BROMINATOR AND A METHOD FOR HOLDING AND TRANSPORTING A PRODUCT

BACKGROUND OF THE INVENTION

The present invention generally relates to a transportable container. More specifically, the present invention relates to a tank within a housing such that the combination is transportable. The present invention further relates to a transportable brominator capable of transporting a large quantity of product and a method for holding and transporting a product without damage to the container in which the product is held or without damage to the product itself.

It is, of course, generally known to provide a stationary brominator from which brominated hydantoin may be stored and fed. Typically, brominated hydantoin or 7346TAB is a product that requires storage and delivery thereof to an application point without exposure to plant personnel. However, brominated hydantoin or 7346TAB is a dry product that generates dusting and pungent odors when dropped from a bucket into such known stationary feeders or brominators. This procedure, however, is the traditional method of delivering the product to a customer for the particular application specified by the customer.

A need, therefore, exists for an improved brominator that is also transportable without risk of damage to the brominator and/or the product contained therein as well as a method for holding and transporting of a hazardous material.

SUMMARY OF THE INVENTION

The present invention provides a container for transporting a product. In addition, the present invention provides a method for holding and transporting a product without damage to the container in which the product is stored and/or the product contained therein.

In an embodiment of the present invention, a container is provided having a tank constructed from a first material having an interior for holding the product. A cage is further provided having an interior constructed from a second material wherein the cage is designed such that the tank is placed in the interior of the cage. A cushion is constructed and arranged between the tank and the cage.

In an embodiment, an inlet valve is constructed and arranged to provide selective access to the interior of the tank. Further, an outlet valve is constructed and arranged to provide selective access to the product in the interior of the tank.

In an embodiment, the first material of the tank is polyethylene reinforced with fiberglass.

In an embodiment, a sightglass is constructed and arranged on the tank to view the interior of the tank.

In an embodiment, the second material of the cage is a metal.

In another embodiment of the present invention, a system is provided for holding and transporting hazardous solids. The system has a container having sidewalls defining an interior holding the solids wherein the sidewalls are constructed from a first material. A shell is further provided having exterior walls defining an interior constructed and arranged such that the container is placed in the interior of the shell wherein the exterior walls of the shell are constructed from a second material different from the first material. A valve is constructed and arranged to provide access to the interior of the container without interference from the shell.

In an embodiment, an outlet valve is constructed and arranged to provide access to the interior of the container without interference from the shell.

In an embodiment, a sightglass is constructed and arranged on the sidewall of the container to view the interior of the container.

In an embodiment, the first material is a plastic and the second material is a metal.

In another embodiment of the present invention, a method is provided for holding and transporting a hazardous material for subsequent filling and dispensing thereof. The method comprises the steps of: providing a container having an interior; inserting the hazardous material into the interior of the container; providing a shell having an interior in which the container is held wherein the container is constructed from a first material and the shell is constructed from a second material different from the first material; and providing a cushioning member between the container and the shell.

In an embodiment, a valve is provided for access to the interior of the container without interference from the shell.

In an embodiment, a sightglass is provided on the container to view the interior of the container without interference from the shell.

In an embodiment, the first material is reinforced plastic.

In an embodiment, the hazardous material is brominated hydantoin.

It is, therefore, an advantage of the present invention to provide a container and a method for holding a product that eliminates the handling and emptying of the product into stationary tanks resulting in dusting from the product.

Another advantage of the present invention is to provide a container and a method for holding and transporting a product in a container that eliminates problems associated with dusting, fuming and lifting of the product.

A still further advantage of the present invention is to provide a container that is transportable and has a high pressure rating.

Yet another advantage of the present invention is to provide a fiberglass vessel for containing the dry material therein.

And, another advantage of the present invention is to provide a container within a closed system.

A still further advantage of the present invention is to provide a container and a method for holding and transporting a product within a container that is not susceptible to clogging.

Moreover, an advantage of the present invention is to provide a container and a method for holding and transporting a product in a container that is simple to feed a product in its unprocessed form.

And, an advantage of the present invention is to provide a container and a method for holding and transporting a product in a container without requiring electrical power for operation.

A still further advantage of the present invention is to provide a container and a method for holding and transporting a product in a container that is economically feasible.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

Figure 1:
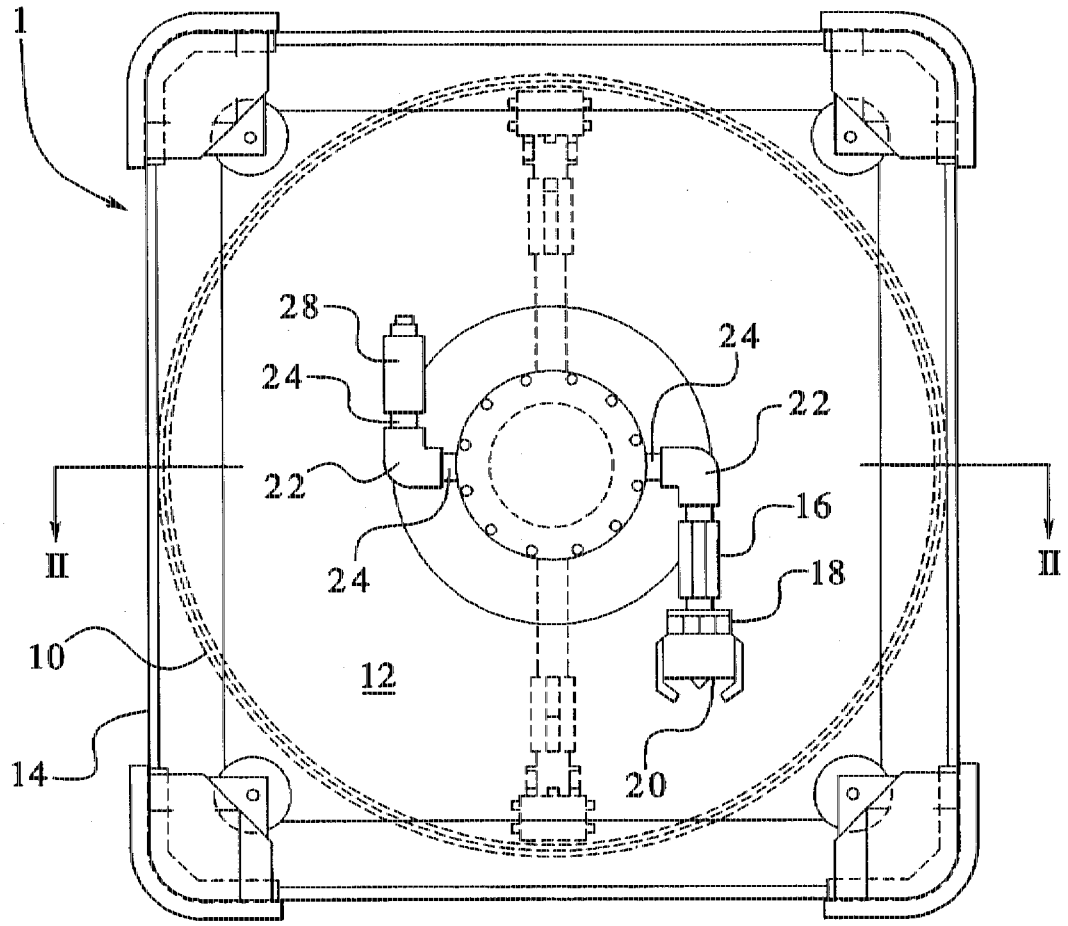
FIG. 1 illustrates a plan view of an embodiment of a transportable brominator of the present invention.

The present invention provides a container and a system for holding and transporting a hazardous material or chemical. Moreover, the present invention provides a method for holding and transporting a chemical or hazardous material, such as brominated hydantoin. (7346TAB).

Referring now to the drawings wherein like numerals refer to like parts, FIGS. 1–4 illustrate an embodiment of a transportable brominator 1 of the present invention. The transportable brominator 1 includes a tank 10 having an interior 12 in which a product, such as brominated hydantoin or 7346TAB, may be input and output from the interior 12 of the tank 10 and transported therein. Of course, other products may be stored and transported in the tank 10. Arranged around the tank 10 is a shell 14. The shell 14 is constructed such that the entire tank 10 is encompassed within an outer periphery of the shell 14. This is more clearly shown in FIG. 3 which will be described in more detail hereinafter.

Figure 2:
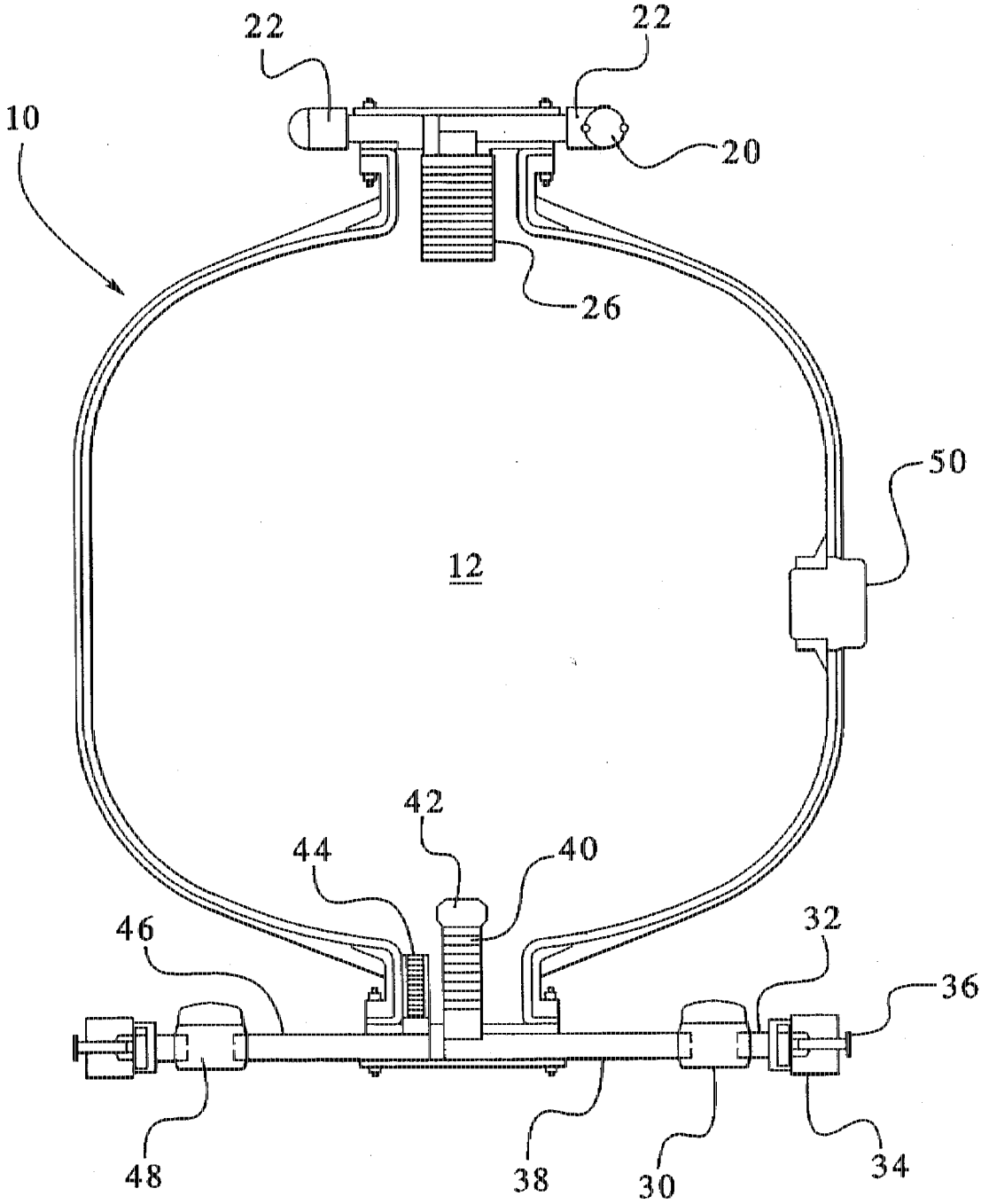
FIG. 2 illustrates a cross-sectional view of an embodiment of a transportable brominator of the present invention taken generally along the lines II—II of FIG. 1.

Referring to FIGS. 1 and 2, the tank 10 includes a ball valve 16, a coupling adapter 18 and a dust cap 20 which, in combination, serves as an outlet of the tank 10. An elbow 22 connects the ball valve 16 to a pipe nipple 24 connected to a strainer 26 in the interior 12 of the tank 10. A second pipe nipple 24 is connected to an elbow 22 and a second pipe nipple 24 that connects to a relief valve 28.

At an opposite end of the outlet side is another ball valve 30 as shown in FIG. 2 which provides an inlet to the interior 12 of the tank 10. The ball valve 30 is coupled to a pipe nipple 32 and coupling adapter 24 and a dust cap 36. A larger pipe nipple 38 provides communication between the ball valve 30 and the interior 12 of the tank 10 via a slotted riser pipe 40 having a cap 42. Further, a slotted drain tube 44 is also provided to fluidly communicate with the interior 12 of the tank 10 such that the interior 12 can be drained via a drain pipe 46 connected to a valve 48 for selective draining of the same.

Figure 3:
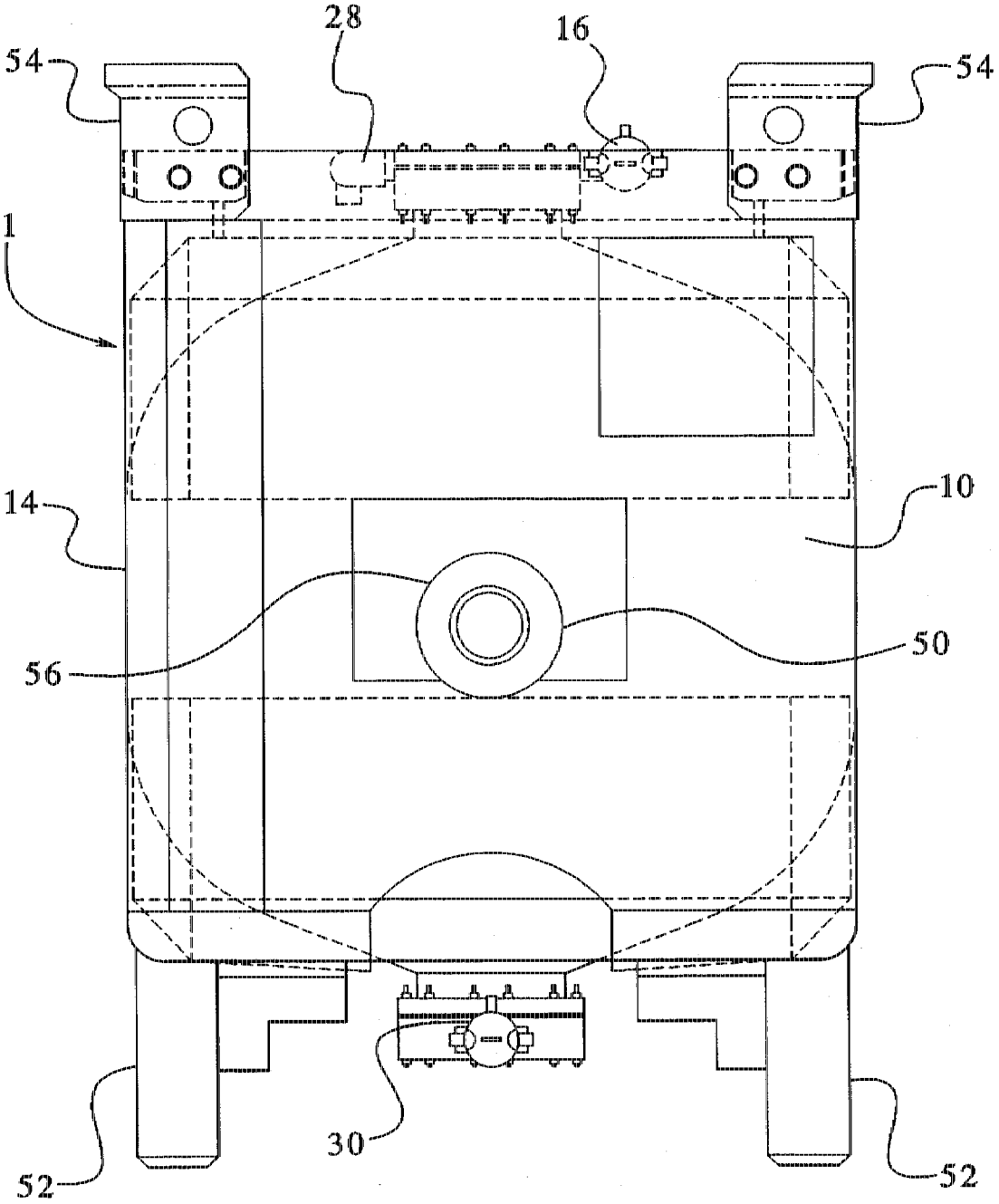
FIG. 3 illustrates a front view of an embodiment of a transportable brominator of the present invention.

In at least one of the sidewalls of the tank 10 is a sightglass 50. The sightglass 50 is constructed and arranged such that an operator may view the interior 12 of the tank 10. To this end, the level of product within the interior 12 of the tank 10 may be monitored by the operator. As shown in FIG. 3, in a embodiment embodiment, the sightglass 50 is circular. Of course, other sizes and shapes of the sightglass 50 may be implemented by those skilled in the art.

As further illustrated in FIG. 3, the shell 14 of the brominator 1 has legs 52 extending from the bottom side of the tank 10 such that the ball valve 30 at the inlet of the tank 10 may be accessed, but not interfered with by the shell 14. Similarly, extensions 54 at an opposite end of the shell 14 from the legs 52 extend such that the ball valve 16 and the relief valve 28 at the outlet end of the tank 10 may be accessed, but interference thereof by the shell 14 is avoided. Further, the legs 52 and the extensions 54 provide complete protection of the tank 10 and its respective valves at each end of the tank. Likewise, the outer wall of the shell 14 includes an opening 56 such that the sightglass 50 in the wall of the tank 10 may be accessed.

Figure 4:
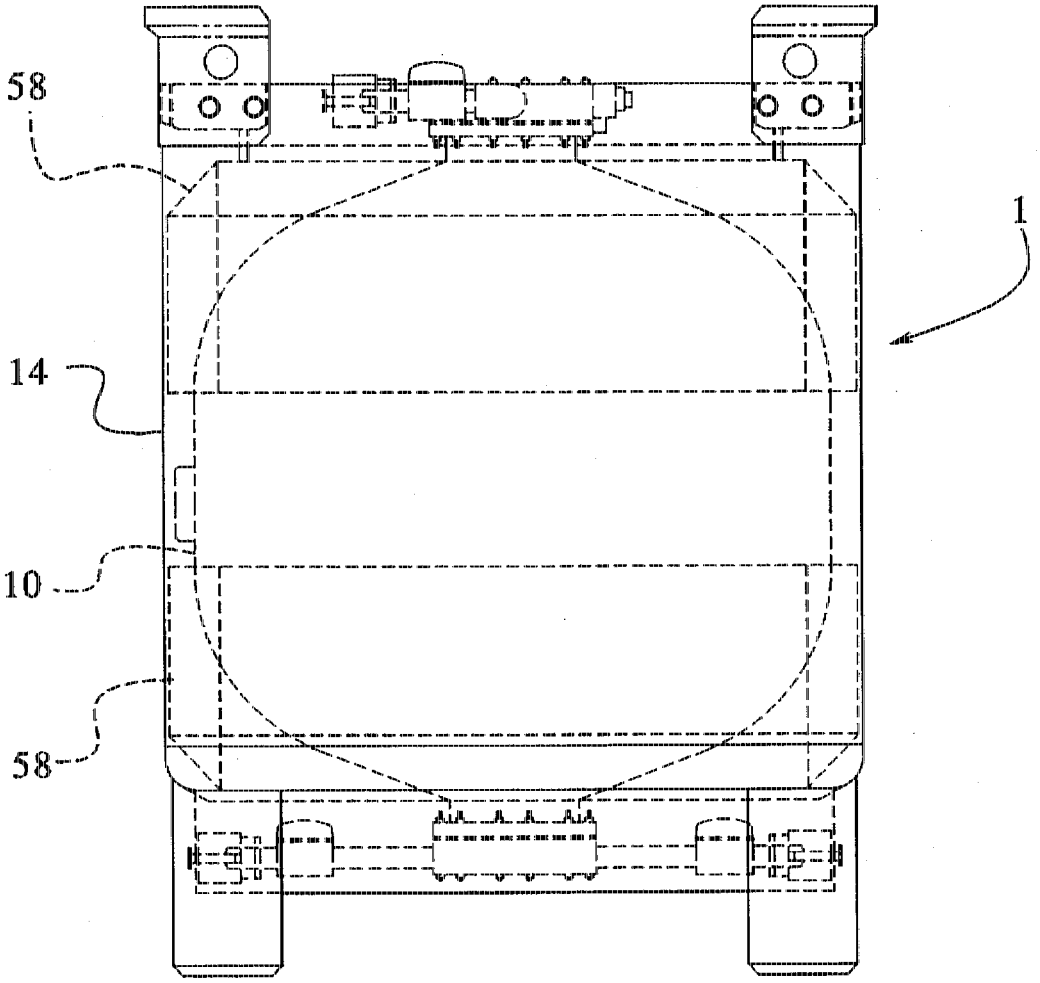
FIG. 4 illustrates a side elevational view of an embodiment of a transportable brominator of the present invention.

As shown in phantom in FIG. 4, inside the shell 14 and exterior to the tank 10, are tank pillows 58. The tank pillows 58 provide cushioning of the tank 10 within the shell 14. Of course, the tank pillows 58 can be made of any desirable material and shaped and designed such that the exterior walls of the tank 10 are sufficiently protected during transport of the brominator 1 which may cause shifting of the tank 10 within the shell 14. Although the tank pillows 58 as illustrated are shown in two pieces at each end of the tank 10, the tank pillows 58 may encompass the entirety of the tank 10 within the shell 14.

Figure 5:
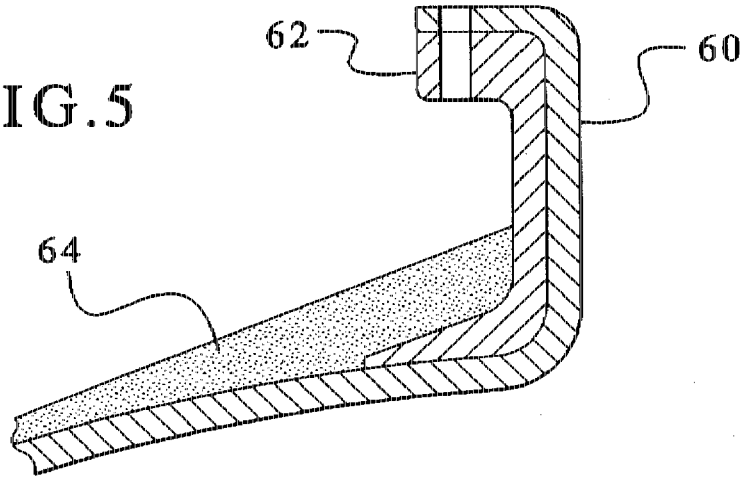
FIG. 5 illustrates an exploded cross-sectional view of a wall of an embodiment of a brominator of the present invention.

Referring now to FIG. 5, an exploded view of the wall of the tank 10 is illustrated. As shown, in a preferred embodiment, the tank 10 includes a first layer 60 consisting of a polyethylene liner. At the illustrated juncture, a teflon-coated aluminum alloy flange 62 is provided. Encompassing the remainder of the tank 10 as more clearly shown in FIG. 2 is a second layer 64 consisting of a filament winding reinforcement. In a preferred embodiment, the preferred filament winding reinforcement layer 64 is seventy percent glass and thirty percent epoxy resin. Of course, other acceptable reinforcement layers may be implemented by those skilled in the art.

The shell 14 is preferably constructed from a metal that may withstand forces exerted thereon and provide protection capabilities to the tank 10 within the shell 14. In a preferred embodiment, the shell 14 is made from stainless steel of sufficient strength to protect the tank 10.

In a preferred embodiment, the tank 10 is capable of holding 120 gallons of product. The present invention has been tested to confirm its survivability from drops of the tank due to, for example, mishandling during transport thereof. Further, the present invention has been tested to verify its ability to feed product and receive product in the tank 10 before and after transport of the brominator 1.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

We claim:

1. A container for transporting a product, the container comprising:

a tank having exterior walls defining a first shape having a volume and constructed from a first material having an interior for holding the product;

a cage having exterior walls defining a second shape distinct from the first shape and further having an interior defining a volume constructed from a second material wherein the cage is designed such that the tank is placed in the interior of the cage wherein the volume of the tank is substantially equal to the volume of the cage; and a cushion constructed and arranged between the tank and the cage in excess space provided due to a difference in the volumes of the tank and the cage wherein a portion of the tank extends to the walls of the cage.

2. The container of claim 1 further comprising:

an inlet valve constructed and arranged to provide selective access to the interior of the tank; and an outlet valve constructed and arranged to provide selective access to the product in the interior of the tank.

3. The container of claim 1 wherein the first material is polyethylene.

4. The container of claim 1 wherein the first material is polyethylene reinforced with fiberglass.

5. The container of claim 1 further comprising:

a sightglass constructed and arranged on the tank to view the interior of the tank.

6. The container of claim 1 wherein the second material is a metal.

7. A system for holding and transporting hazardous solids, the system comprising:

a container having sidewalls defining a first shape with an interior holding the solids wherein the sidewalls are constructed from a first material;

a shell having exterior walls defining a second shape distinct from the first shape with an interior constructed and arranged such that the container is placed in the interior of the shell wherein the exterior walls of the shell are constructed from a second material different from the first material wherein the container substantially fills the interior of the shell and a portion of the container extends to the walls of the shell;

a valve constructed and arranged to provide access to the interior of the container without interference from the shell; and a cushion situated between the sidewalls of the container and the exterior walls of the shell in an area not filled by the container.

8. The system of claim 7 further comprising:

an outlet valve constructed and arranged to provide access to the interior of the container without interference from the shell.

9. The system of claim 7 further comprising:

a sightglass constructed and arranged on the sidewall of the container to view the interior of the container.

10. The system of claim 7 wherein the first material is a plastic.

11. The system of claim 7 wherein the first material is polyethylene.

12. The system of claim 7 wherein the first material is reinforced polyethylene.

13. The system of claim 7 wherein the second material is a metal.

* * * * *